US007661530B1

(12) United States Patent
Hewitt

(10) Patent No.: US 7,661,530 B1
(45) Date of Patent: Feb. 16, 2010

(54) PILL ORGANIZER CONTAINING DISPOSABLE RECEPTACLES

(76) Inventor: William Hewitt, 2786 School Dr. NE., Palm Bay, FL (US) 32905

( * ) Notice: Subject to any disclaimer, the term of this patent is extended or adjusted under 35 U.S.C. 154(b) by 322 days.

(21) Appl. No.: 11/713,777

(22) Filed: Mar. 5, 2007

(51) Int. Cl.
*B65D 83/04* (2006.01)

(52) U.S. Cl. ..... 206/528; 206/538; 206/534; 220/523

(58) Field of Classification Search ..... 206/538, 206/539, 528, 534, 488; 220/523, 526–528
See application file for complete search history.

(56) References Cited

U.S. PATENT DOCUMENTS

| | | | | |
|---|---|---|---|---|
| 4,693,371 | A * | 9/1987 | Malpass | 206/538 |
| 4,749,085 | A | 6/1988 | Denney | 206/534 |
| 5,050,756 | A * | 9/1991 | Tielker et al. | 220/23.4 |
| 5,286,949 | A * | 2/1994 | Simons | 219/222 |
| 5,344,024 | A * | 9/1994 | Cohu | 206/526 |
| 5,366,069 | A * | 11/1994 | Seidner | 206/0.84 |
| 6,138,831 | A * | 10/2000 | Agostinelli | 206/541 |
| 6,167,680 | B1 * | 1/2001 | Horn | 53/473 |
| 6,464,506 | B1 | 10/2002 | Welles | 434/238 |
| 6,595,365 | B1 * | 7/2003 | Wigmore | 206/538 |
| 7,326,428 | B2 * | 2/2008 | Weir | 426/120 |
| 2006/0006091 | A1 * | 1/2006 | Maietta | 206/539 |

* cited by examiner

*Primary Examiner*—Ehud Gartenberg
*Assistant Examiner*—Robert Poon
(74) *Attorney, Agent, or Firm*—LaMorte & Associates

(57) ABSTRACT

A pill organizer assembly and the associated method of organizing and isolating multiple doses of pharmaceuticals using a pill organizer. The pill organizer includes a holding case. A plurality of partition walls extend between the side walls in the holding case. The partition walls define a plurality of compartments. A lid is provided that is selectively positionable into a closed position on the holding case. A plurality of removable receptacles are provided. A removable receptacle is disposed within each of the plurality of compartments. The lid creates a seal against each of the removable receptacles when the removable receptacles are within the plurality of compartments and the lid is in its closed position. The seal created by the lid isolates the contents of the removable receptacles until they are removed from the holding case.

10 Claims, 3 Drawing Sheets

PILL ORGANIZER CONTAINING DISPOSABLE RECEPTACLES

BACKGROUND OF THE INVENTION

1. Field of the Invention

In general, the present invention relates to pill organizers that hold pills in dose units and enable a patient to keep track of when and if the pills have been taken properly. More particularly, the present invention relates to the structure of such pill organizers and features intended to maintain the cleanliness of such pill organizers.

2. Prior Art Description

Many people take pills on a regular basis. The pills taken may be vitamin pills or nutritional supplement pills. Many times the pills taken by a person are necessary to treat a medical condition or disease. Regardless of why pills are taken, if the pills are taken on a regular basis, it is very easy for a person to forget that certain pills were taken at certain times. If a person forgets they have already taken a pill and takes the same pill again, that person may overdose or otherwise experience an adverse reaction. If a person forgets to take a pill, that person may lack the benefits provided by the pill. Both scenarios present significant health risks to a person.

To complicate matters, the number of pills taken regularly by a person tends to increase with age. Furthermore, short-term memory tends to decrease with age. Accordingly, it is very common for an elderly person to forget whether or not they have taken their medications in a timely fashion.

Recognizing the need to help people keep track of medications, pill organizers have been developed. Pill organizers are storage containers that are divided into various compartments. Often the pill organizer has several compartments to represent the seven days of the week. Pills are placed into each of the compartments at the beginning of the week. A person then takes the pills from one of the compartments everyday. If a person sees that the "Monday" compartment is empty, he/she knows that the pills for that day have already been taken. Such prior art pill organizers are exemplified by U.S. Pat. No. 6,464,506 to Welles, entitled INFORMATION AND MEDICATION COMPLIANCE ORGANIZER and U.S. Pat. No. 4,749,085, to Denney, entitled PILL BOX HOLDER.

Often, a prior art pill organizer is a plastic box that defines a plurality of small square compartments. The pills are placed into the compartments. In order to take the pills, a person must first reach into the small compartment and remove the pills. This seams simple, but it often is not. Many pills are very small. It is difficult to reach and grab such pills at the bottom of a narrow compartment. The task is far more difficult for elderly patients that may have arthritis in their hands and/or poor eyesight.

Another problem associated with prior art pill organizers is one of cross-contamination. When pills are placed inside a small compartment, some fragment dust from that pill remains inside the pill compartment. The fragment dust may then contaminate other pills that are subsequently placed inside the pill organizer. For example, many cholesterol lowering drugs are known to cause birth defects in pregnant women. Pregnant women are advised against even touching such drugs. If a pregnant woman uses a pill organizer to organize her prenatal medications, and that pill organizer is contaminated with cholesterol lowering drugs from previous usage, serious consequences may result.

Yet another disadvantage of prior art pill organizers is that the pills within the organizers are not isolated from the surrounding environment. Pills may lay in a pill organizer for days or weeks, depending upon the size of the organizer. Many pills contain pharmaceutical compounds that are adversely affected by humidity and other environmental factors, such as heat and light. Such pills are typically held within sealed pill cases provided by the pharmacy. However, when the pill is removed from the pill case and is placed in the pill organizer, the pill becomes exposed to the surrounding environment for possibly a prolonged period of time.

A need therefore exists for an improved pill organizer that not only tracks the taking of medications, but also makes the medications easily accessible and prevents potentially dangerous cross-contamination and environmental degradation. This need is met by the present invention as described and claimed below.

SUMMARY OF THE INVENTION

The present invention is a pill organizer assembly and the associated method of organizing and isolating multiple doses of pharmaceuticals using a pill organizer.

The pill organizer includes a holding case having a bottom surface, side walls and an open top. A plurality of partition walls extend between the side walls in the holding case. The partition walls define a plurality of compartments. A lid is provided that is selectively positionable into a closed position on the holding case. The lid covers the open top of the holding case when it is in its closed position.

A plurality of removable receptacles are provided. A removable receptacle is disposed within each of the plurality of compartments. The lid creates a seal against each of the removable receptacles when the removable receptacles are within the plurality of compartments and the lid is in its closed position. The seal created by the lid isolates the contents of the removable receptacles until they are removed from the holding case.

To utilize the pill organizer assembly, a dose of pharmaceuticals is placed into each of the removable receptacles. The filled removable receptacles are placed into the various compartments within the holding case. The lid is maneuvered into its closed position over the holding case. The lid creates a seal against each of the removable receptacles, therein isolating the pharmaceuticals contained therein. To access the pharmaceuticals, the lid is opened and the removable receptacle containing the pharmaceutical is removed. Once used, the removable receptacle is discarded in order to prevent cross-contamination.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE DRAWINGS

Although the present invention can be used to hold and track many different objects, it is primarily intended for use in holding and tracking medications in pill form. Accordingly, the present invention pill organizer assembly is illustrated and described holding pills in order to set forth the best mode contemplated for the invention. It should, however, be understood that the objects being placed in the pill organizer are discretionary to the user and should not be considered a limitation on the invention, as defined by the claims.

Figure 1:
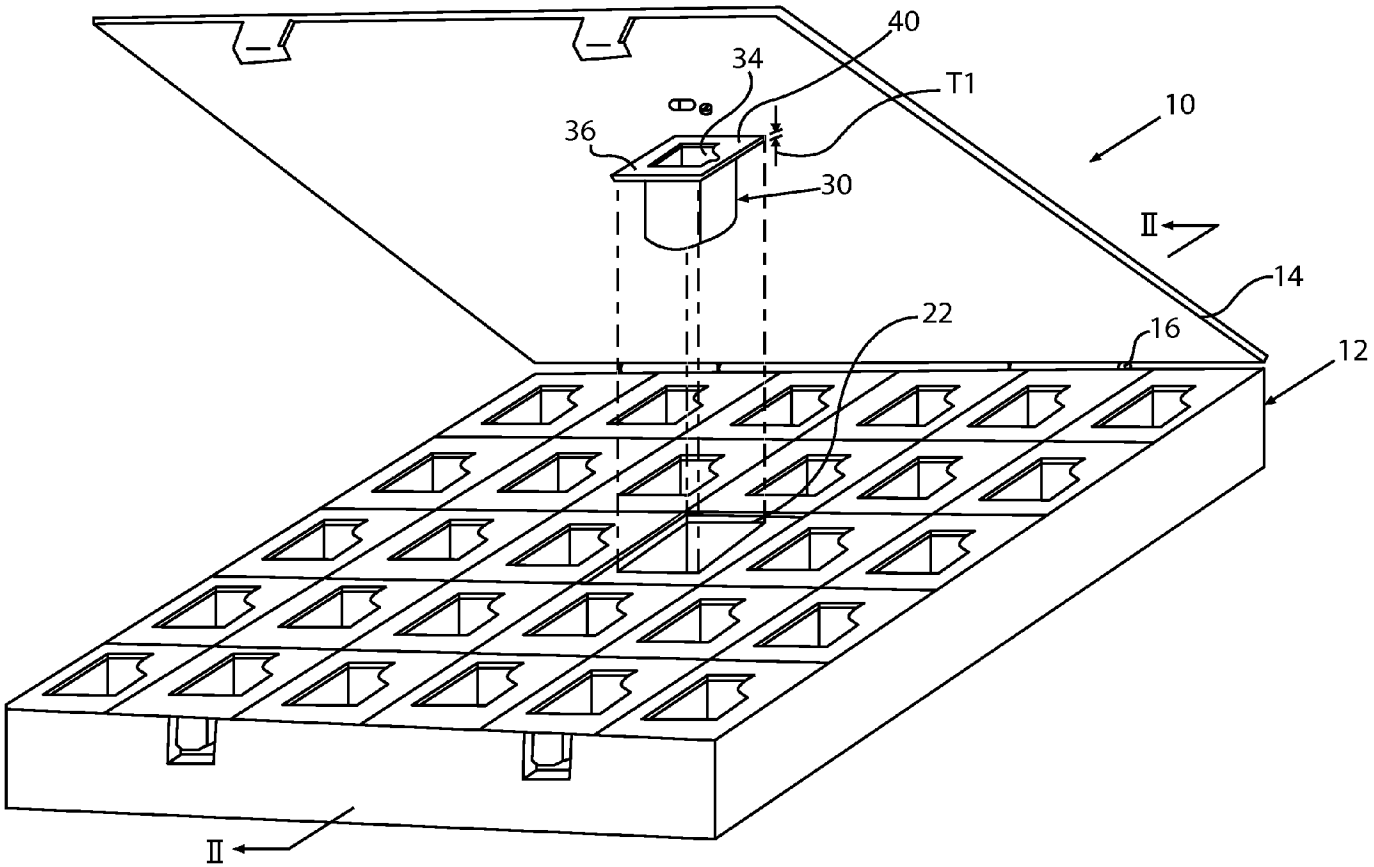
FIG. 1 is an exploded perspective view of an exemplary embodiment of a pill organizer assembly.
Figure 2:
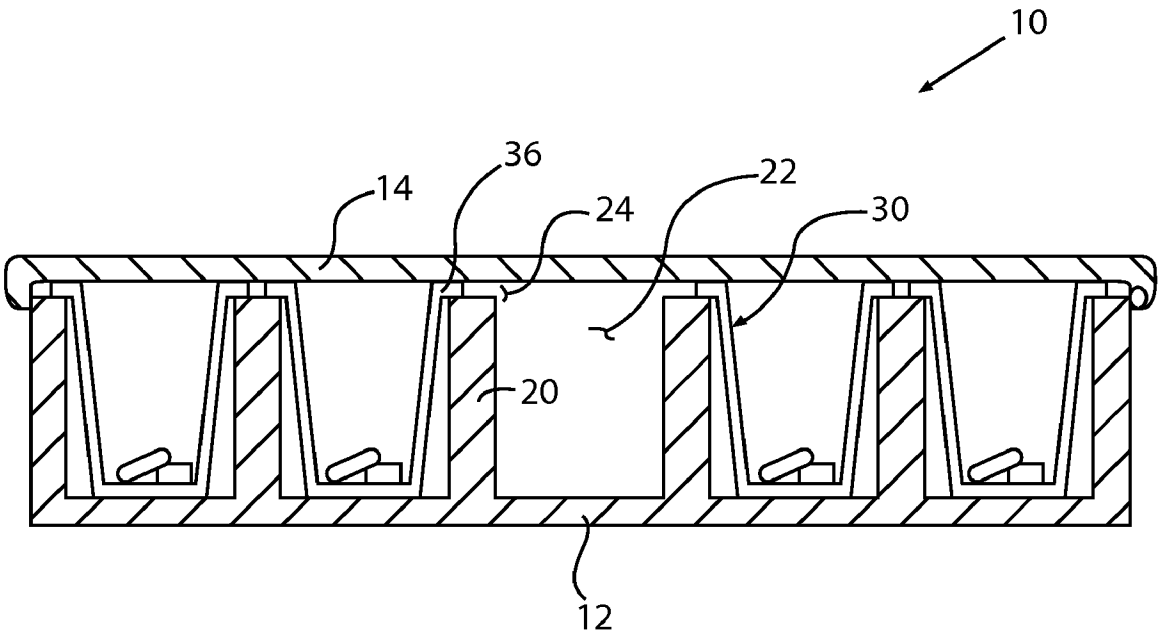
FIG. 2 is a cross-sectional view of the embodiment of FIG. 1.

Referring to FIG. 1 in conjunction with FIG. 2, there is shown an exemplary embodiment of a pill organizer assembly 10. The pill organizer assembly 10 includes a holding case 12. The holding case 12 has a lid 14 that enables the holding case 12 to be selectively opened and closed. The lid 14 can be removable from the holding case 12, but is preferably connected to the holding case 12 with a hinge connection 16.

The holding case 12 contains a plurality of partition walls 20 within its interior. The partition walls 20 divide the interior of the holding case 12 into a plurality of compartments 22, wherein each of the compartments 22 preferably has the same dimensions. The preferred length, width and depth of each compartment 22 are between one inch and three inches. When the lid 14 is closed on the holding case 12, a gap space 24 exists between the lid 14 and the tops of the partition walls 20. The gap space 24 is uniform across the entire case.

A plurality of disposable serving receptacles 30 are provided. Each serving receptacle 30 has walls 32 that define a cup structure with an open top 34. Each serving receptacle 30 is sized to hold between one and ten pills. Accordingly, the preferred volume of each serving receptacle 30 is preferably no larger than eight cubic inches. The serving receptacles 30 are preferably made out of thin plastic or paper and are therefore very low cost. Each serving receptacle 30 preferably has a flange lip 36 that extends around the periphery of the open top 34. Each serving receptacle 30 also has a length, width and height that enable the serving receptacle 30 to pass into one of the compartments 22.

The flange lip 36 is larger than the compartment 22 in which it sits. Consequently, the flange lip 36 rests upon the top of the partition walls 20 that define the compartments 22. The height of the serving receptacle 30 is equal to or shorter than the depth of the compartments 22. Accordingly, when a serving receptacle 30 is placed into a compartment 22, the flange lip 36 seats flush against the top of the partition walls 20.

The flange lip 36 has a thickness T1 that is equal in size to, or just slightly larger than, the gap space 24 in between the lid 14 and the top of the partition walls 20. Accordingly, when the lid 14 is shut onto the holding case 12, the lid 14 presses against the flange lip 36 creating a seal between the flange lip 36 of the serving receptacle 30 and the lid 14. The seal created by the lid 14 contacting the top of the flange lip 36 is important because it isolates the contents of the serving receptacle 30. Consequently, even if the holding case 12 is dropped, shaken or otherwise disturbed, the contents from any one serving receptacle 30 cannot contaminate the contents of any of the other serving receptacles 30. Furthermore, provided the lid 14 remains closed, the pills in the various serving receptacles 30 are all isolated from environmental contaminants, such as humidity and dust particles. When the lid 14 is open, the pills in all of the serving receptacles 30 become momentarily exposed to the ambient environment. But the exposure is only temporary. As soon as the lid 14 is closed on the holding case 12, all seals are reestablished. Only a small amount of ambient air remains in each of the serving receptacles 30. Any contaminants in such small volumes of air are unlikely to adversely affect any of the exposed pills.

Since the lid 14 closes against the flange lip 36 of the serving receptacles 30, the flange lip 36 must lay flat. To help facilitate a person grasping each of the serving receptacles 30, a tab 40 is provided. The tab 40 extends inwardly toward the interior space defined by the serving receptacle 30. The tab 40 provides a structure that is easily grasped so that the serving receptacle 30 can be manually lifted out of the holding case 12. By positioning the tab 40 in such a manner, the tab 40 does not disturb the ability of the lid 14 to seal the open tops 34 of each of the serving receptacles 30.

To utilize the pill organizer assembly 10, a plurality of serving receptacles 30 are filled with pills that need to be taken on a regular basis, i.e. every few hours, twice a day, daily or the like. The serving receptacles 30 are then placed into the various compartments 22 within the holding case 12. In the shown embodiment, there are thirty compartments. Such a configuration can hold daily medications for a month, i.e. thirty days. The filled serving receptacles 30 are placed into the various compartments of the holding case 12. The lid 14 is then closed. As the lid 14 is closed, the flange lip 36 around every one of the serving receptacles 30 is compressed against the lid 14. This isolates the pills inside each of the serving receptacles 30. Accordingly, the pills are not exposed to ambient humidity or other environmental contaminants that can degrade the effectiveness of the pills.

When desired, a person opens the lid 14 of the pill organizer assembly 10 and removes one of the serving receptacles 30. The lid 14 of the pill organizer assembly 10 is then closed, therein minimizing the exposure of the pill organizer assembly to the surrounding environment. The pills contained within the serving receptacle 30 are consumed and the serving receptacle 30 is thrown away. In this manner, any contamination that remains within the serving receptacle 30 is not reintroduced back into the pill organizer assembly 10. Concerns about pill contamination of the various compartments 22 is therefore eliminated. The next time the pill organizer assembly 10 is filled, new serving receptacles 30 are used.

Figure 3:
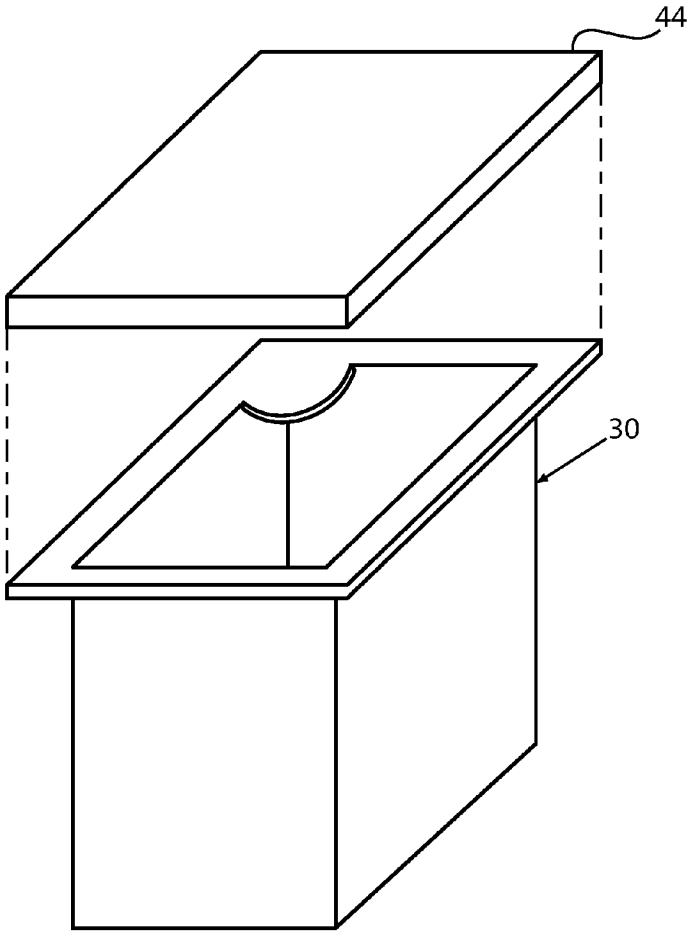
FIG. 3 is a perspective view of an alternate embodiment of a removable receptacle.

In the embodiment of the pill organizer assembly 10 expressed in FIG. 1 and FIG. 2, the various serving receptacles 30 have open tops 34 and no individual covers. Referring to FIG. 3, the serving receptacle 30 is shown with a cover 44. The serving receptacle 30 is the same as has been previously described. However, the cover 44 that is provided seals the top of the serving receptacle 30 before it is placed into the holding case 12. The lid 14 (FIG. 1) is biased onto the cover 44 when the lid 14 (FIG. 1) is closed on the holding casing 12 (FIG. 1), thereby holding the covers 44 closed.

A serving receptacle 30 with an individual cover 44 can be used to hold liquid pharmaceuticals and pharmaceuticals that are highly susceptible to contamination degradation or potentially dangerous cross-contamination.

It will be understood that the embodiments of the present invention pill organizer assembly that are described and illustrated are merely exemplary. Accordingly, a person skilled in the art can make many variations, modifications and alternate embodiments using functionally equivalent components. For instance, the serving receptacles and the compartments in the holding case can both have shapes other than the square shapes shown. Furthermore, the number of compartments in the holding case can be altered as a matter of design choice. All such alternate embodiments are intended to be included within the scope of the present invention as defined by the claims.

What is claimed is:

1. A pill organizer assembly, comprising:

a holding case having a bottom surface, side walls and an open top;

a plurality of partition walls extending between said side walls in said holding case, wherein said partition walls and said side walls combine to define a plurality of compartments within said holding case;

a lid selectively positionable into a closed position on said holding case, wherein said lid covers said open top of said holding case when in said closed position, and wherein a uniform gap space exists between said partition walls and said lid when said lid is in said closed position;

a plurality of removable receptacles, wherein a removable receptacle is disposed within each of said plurality of compartments, and wherein each of said removable receptacles has a flange lip that radially extends from each of said removable receptacles so that at least a portion of each said flange lip rests upon at least some of said partition walls when said removable receptacles are positioned within said plurality of compartments; and wherein each said flange lip has a thickness at least as large as said gap space, therein causing each said flange lip to seal against each of said removable receptacles when said removable receptacles are within said plurality of compartments and said lid is in said closed position.

2. The assembly according to claim 1, wherein said plurality of compartments within said holding case includes a different compartment for every day in a month.

3. The assembly according to claim 1, further including individual covers for each of said removable receptacles.

4. The assembly according to claim 1, wherein each of said removable receptacles has an open interior space large enough to receive a plurality of pills.

5. The assembly according to claim 4, wherein each of said removable receptacles has a tab that extends inwardly toward said open interior space that facilitates the manual grasping and lifting of said removable receptacles.

6. The assembly according to claim 1, wherein each of said plurality of compartments are of the same size.

7. The assembly according to claim 1, wherein each of said removable receptacles are the same size.

8. The assembly according to claim 7, wherein each of said removable receptacles has a volume capacity of less than eight cubic inches.

9. A method of organizing and isolating multiple doses of pharmaceuticals, comprising the steps of:

providing a holding case that is segmented into a plurality of separate compartments that are separated by partition walls, wherein said holding case has a lid that can be selectively maneuvered into a closed position;

providing a plurality of disposable receptacles wherein each of said disposable receptacles has a flange lip;

placing a dose of pharmaceuticals into at least some of said disposable receptacles;

placing said disposable receptacles containing a dose of pharmaceuticals into said separate compartments so that said flange lip from said disposable receptacles rest upon said partition walls;

maneuvering said lid into said closed position, wherein said lid compresses each said flange lip and creates a seal, therein isolating said dose of pharmaceuticals contained in said disposable receptacles.

10. The method according to claim 9, wherein said step of providing a holding case, includes providing a holding case segmented into at least twenty-eight separate compartments.

* * * * *